US008146787B2

(12) United States Patent
Cragg

(10) Patent No.: US 8,146,787 B2
(45) Date of Patent: Apr. 3, 2012

(54) CARRYING BAG

(75) Inventor: James Victor Cragg, Carson, CA (US)

(73) Assignee: S.O. Tech Special Operations Technologies, Inc., Carson, CA (US)

( * ) Notice: Subject to any disclaimer, the term of this patent is extended or adjusted under 35 U.S.C. 154(b) by 495 days.

(21) Appl. No.: 12/475,417

(22) Filed: May 29, 2009

(65) Prior Publication Data

US 2010/0252598 A1 Oct. 7, 2010

Related U.S. Application Data

(60) Provisional application No. 61/131,937, filed on Jun. 13, 2008.

(51) Int. Cl.

| | |
|---|---|
| ***A45C 1/04*** | (2006.01) |
| ***A45C 13/26*** | (2006.01) |
| ***A45C 13/30*** | (2006.01) |
| ***A45F 3/00*** | (2006.01) |
| ***F41C 33/02*** | (2006.01) |
| ***F42B 39/02*** | (2006.01) |

(52) U.S. Cl. ..... 224/680; 224/578; 224/645; 224/222; 224/660; 224/240; 224/579; 150/107; 150/108; 150/109; 150/110

(58) Field of Classification Search ..... 224/578, 224/645, 222, 660, 240, 579; 150/107–110
See application file for complete search history.

(56) References Cited

U.S. PATENT DOCUMENTS

| | | | | |
|---|---|---|---|---|
| 5,025,965 | A * | 6/1991 | Smith | 224/660 |
| 5,119,910 | A * | 6/1992 | Heggeland | 190/116 |
| 5,172,838 | A * | 12/1992 | Rowell et al. | 224/680 |
| 5,205,448 | A * | 4/1993 | Kester et al. | 224/575 |
| 5,228,609 | A * | 7/1993 | Gregory | 224/617 |
| 5,361,953 | A | 11/1994 | Nichols | |
| 5,570,824 | A * | 11/1996 | Lyon et al. | 224/240 |
| 5,873,504 | A * | 2/1999 | Farmer | 224/576 |
| 5,887,770 | A | 3/1999 | Covel | |
| 6,209,769 | B1 | 4/2001 | Seals et al. | |
| 6,622,899 | B1 | 9/2003 | Klindworth-Garron | |
| 6,648,196 | B2 | 11/2003 | Morrison et al. | |
| D482,865 | S * | 12/2003 | Fair | D3/267 |
| 7,007,838 | B1 | 3/2006 | Bostick, II | |
| 2003/0006261 | A1 * | 1/2003 | Morrison et al. | 224/578 |
| 2008/0169325 | A1 * | 7/2008 | Amishay | 224/579 |

* cited by examiner

*Primary Examiner* — Nathan J Newhouse
*Assistant Examiner* — Derek Battisti
(74) *Attorney, Agent, or Firm* — Cislo & Thomas, LLP

(57) ABSTRACT

A carrying bag comprising a main compartment having a front panel, a back panel and two side panels; two side flaps attached to the back panel protruding laterally; and a carrying strap having a first end attached to the first side flap and a second end attached to the second side flap, wherein the first and second side flaps have a first configuration and a second configuration, wherein in the first configuration, the side flaps project upwards so that the carrying strap can function as a shoulder strap and in the second configuration, the side flaps can be folded and secured onto itself to project laterally and function as a waist strap.

20 Claims, 10 Drawing Sheets

CARRYING BAG

CROSS-REFERENCE

This patent application claims the benefit of U.S. Provisional Patent Application Ser. No. 61/131,937, entitled "Carrying Bag," filed Jun. 13, 2008.

TECHNICAL FIELD

This invention relates to carrying bags with carrying straps that can function as waist straps or shoulder straps.

BACKGROUND ART

In general, military personnel tend to carrying numerous items and gear for a variety of functions. With the advent of technology, these items and gear tend to be smaller and smaller, allowing military personnel to carry more and more. A common concern for those entering the field is that they are adequately supplied without significantly obstructing their maneuverability.

A carrying bag allows one to carry a variety of gear. Most carrying bags are provided with carrying straps that hang on a person's shoulder for ease of carrying. Carrying a bag on the shoulder, however, is not always the most effective method of carrying a bag as it can easily slip off or flop around during certain movements, such as running or bending over. Under these circumstances it may be more convenient to carry the bag attached to the waist. There are circumstances when it would be preferable to carry the bag on the shoulder to ease the weight of the bag, for example, while standing around or during slow walks.

Besides the military, civilians could also use carrying bags that can be carried either on the waist or on the shoulder as dictated by the circumstance.

There are carrying bags in which the straps can be adjusted to serve as shoulder straps or waists straps. These bags, however, utilize complicated or unnecessary rotating or swiveling mechanisms. Other simpler models have bendable straps that can be bent into different orientations to allow a carrying strap to convert from a shoulder strap to a waist strap. These bags, however, are weak and may be prone to damage such as ripping due to the bent configuration. Others may have multiple fastening sites for the attaching the strap requiring detachment and reattachment of the carrying strap, which may also be aesthetically unappealing. Still others require removing the shoulder strap and reinserting the carrying strap into loops in a different configuration, which is time consuming.

Thus, there is still a need for a carrying bag that can be easily converted from a shoulder bag to a waist bag without complicated devices or multiple attachment sites that is sturdy and durable enough to withstand the rigors of the military while being aesthetically pleasing for civilians.

DISCLOSURE OF INVENTION

The present invention is directed to a carrying bag designed for comfort, versatility and strength. The carrying bag comprises a main compartment, a front panel, a back panel, two side panels, two side flaps attached to the back panel protruding laterally, and a carrying strap having a first end attached to the first side flap and a second end attached to the second side flap, wherein the first and second side flaps have a first configuration and a second configuration. In the first configuration, the side flaps project upwards so that the carrying strap can function as a shoulder strap and in the second configuration, the side flaps can be folded and secured onto itself to project laterally and function as a waist strap.

Thus, the carrying bag may be easily configured from a shoulder bag to a waist/fanny pack. The carrying strap may be stored in a pocket so the bag can be used as a briefcase. Using a quick-release fastener, the carrying bag may be attached to a vest or another bag or pack.

MODES FOR CARRYING OUT THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1A:
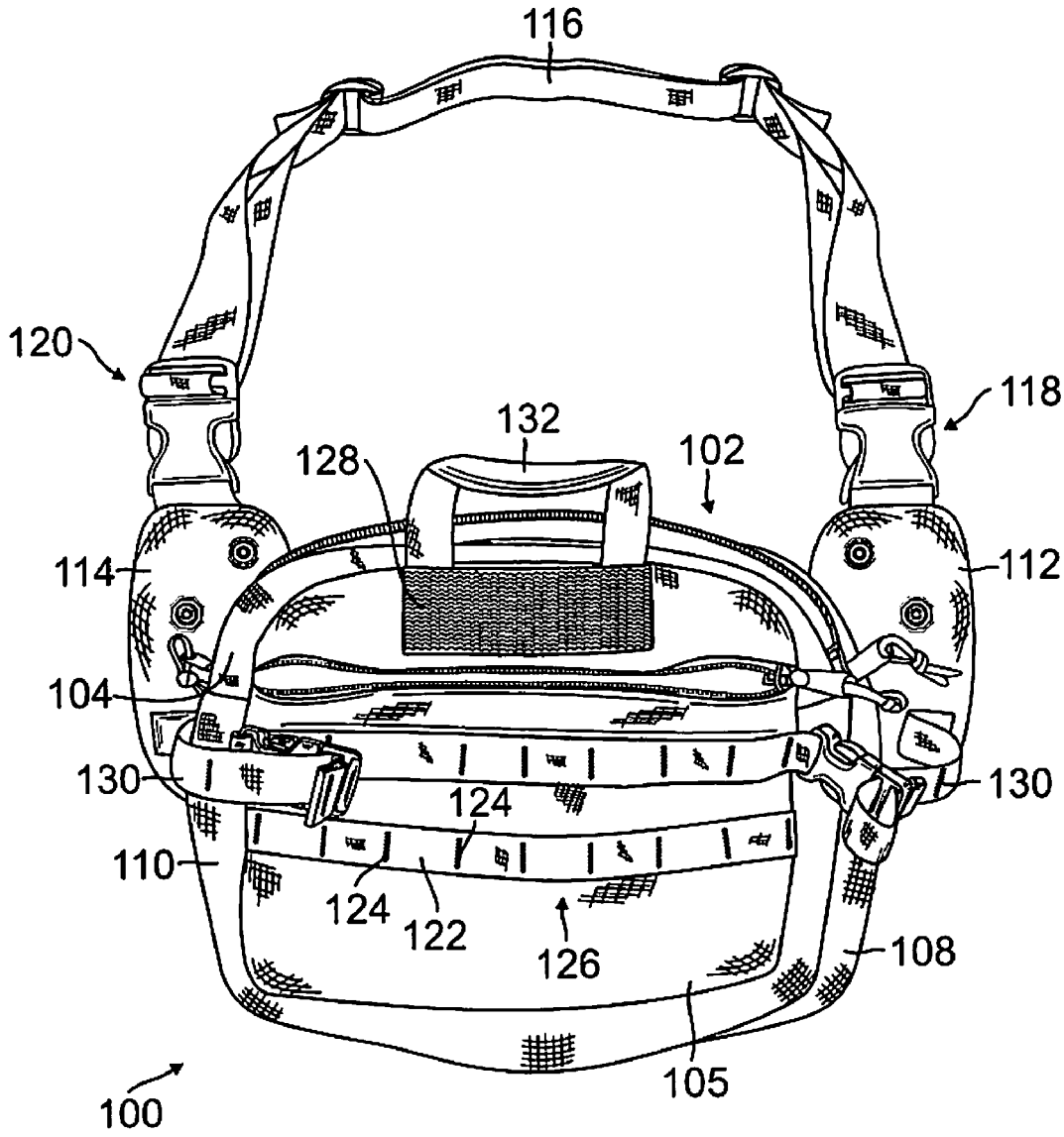
FIG. 1A is a front view of an embodiment of the current invention in a first configuration.
Figure 1B:
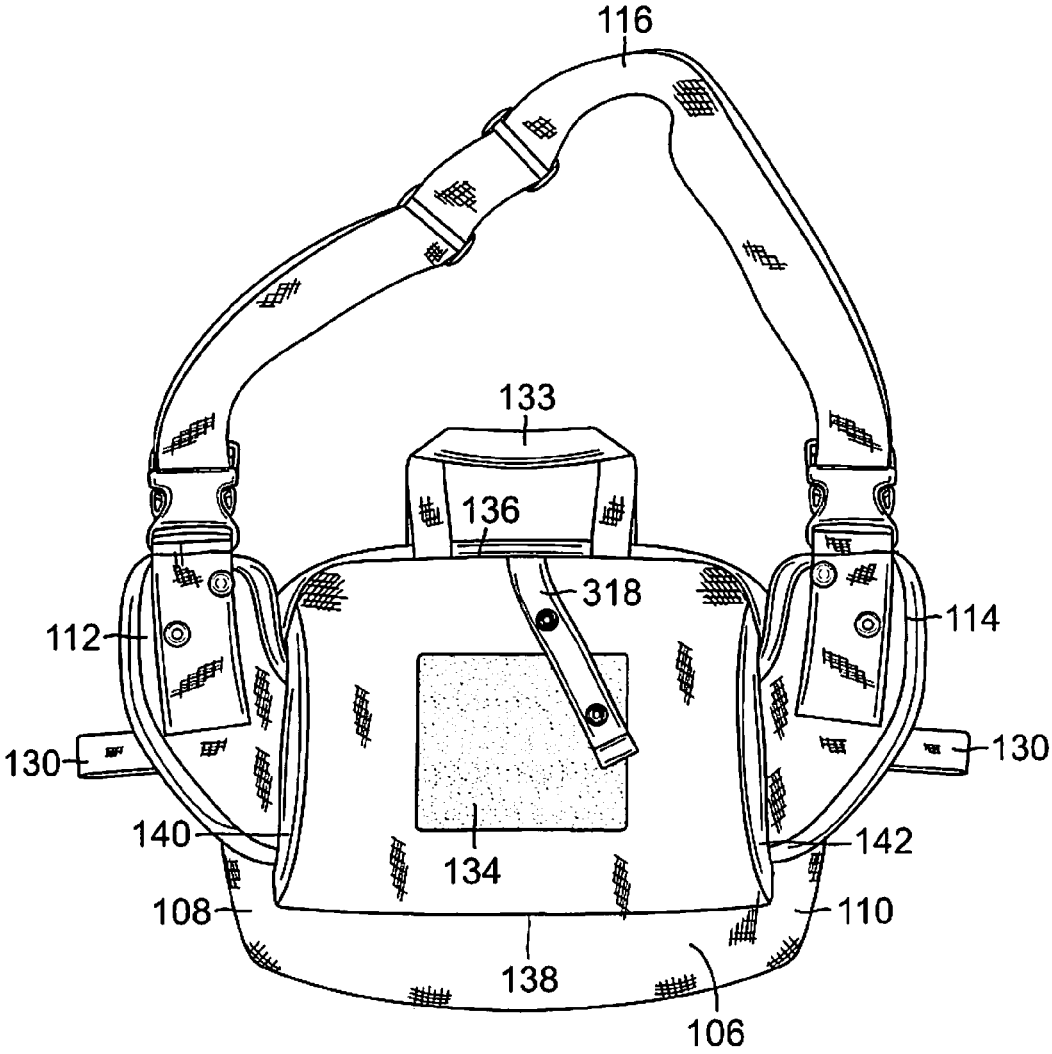
FIG. 1B is rear view of an embodiment of the current invention in the first configuration.
Figure 2A:
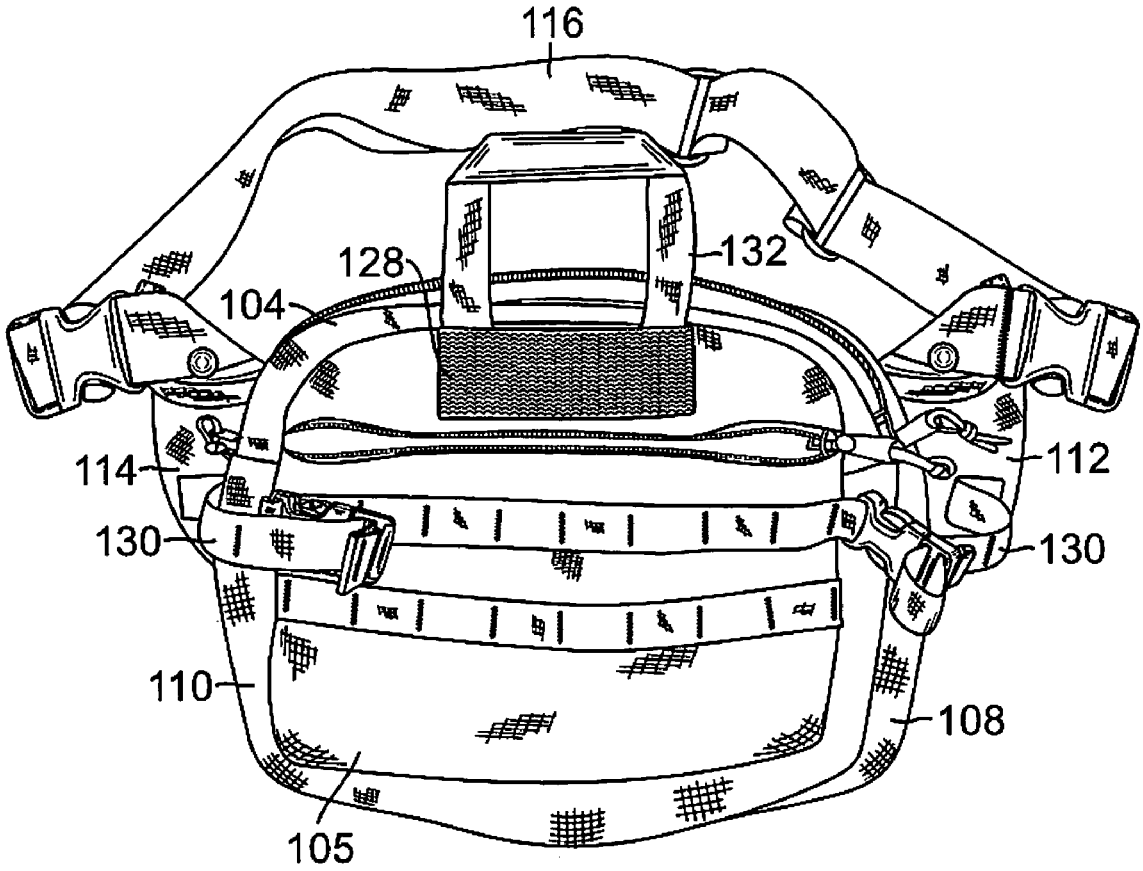
FIG. 2A is a front view of an embodiment of the current invention in a second configuration.
Figure 2B:
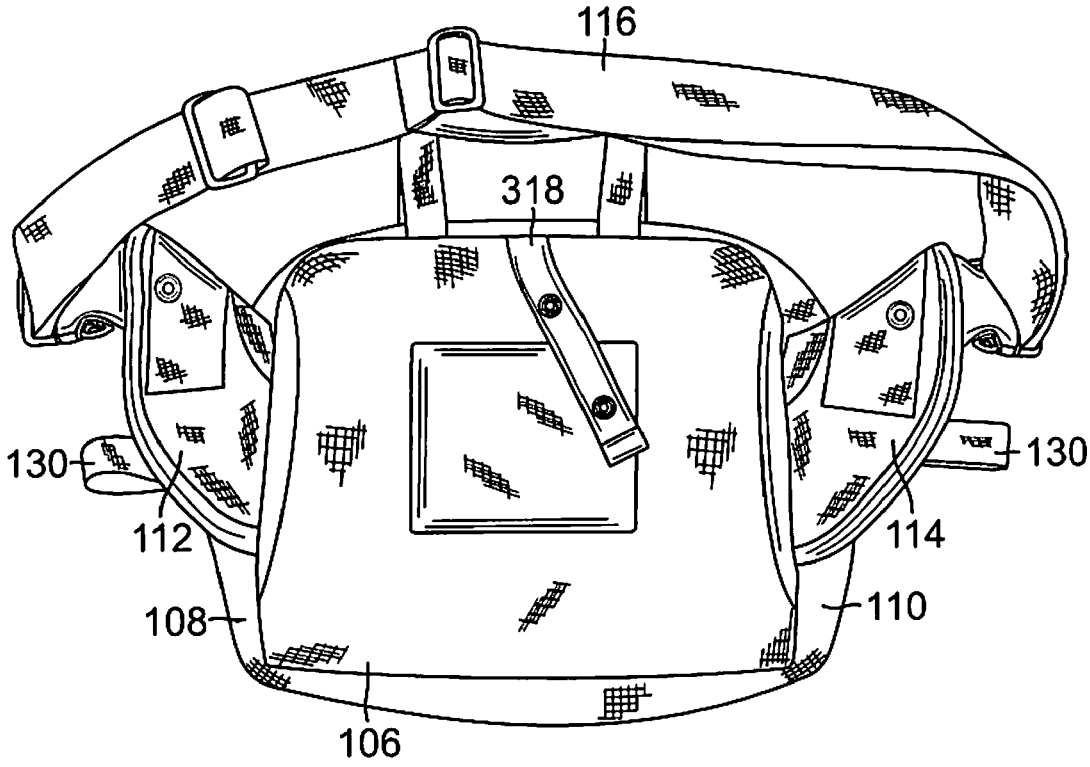
FIG. 2B is a rear view of an embodiment of the current invention in the second configuration.
Figure 7:
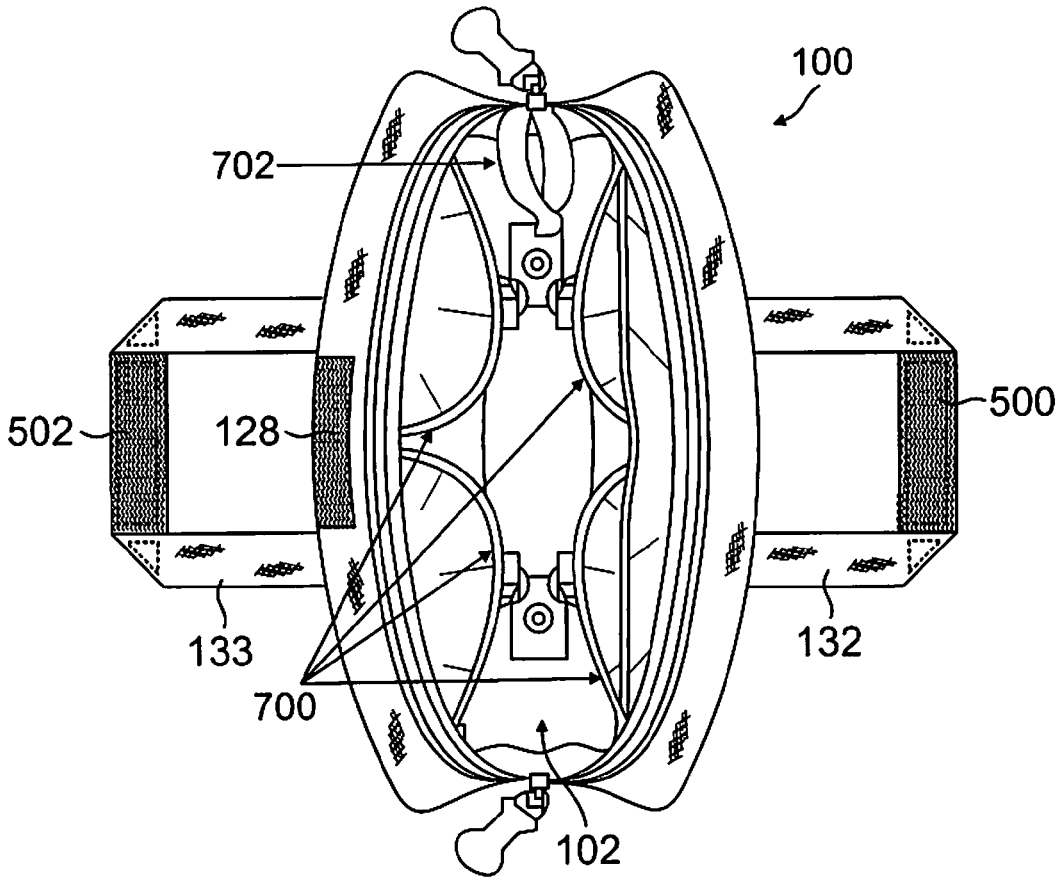
FIG. 7 is a top view of an embodiment of the current invention.

As shown in FIGS. 1A, 1B, and 7, the carrying bag 100 comprises a main compartment 102; a front panel 104; a back panel 106; two side panels 108, 110; two side flaps 112, 114 attached to the back panel 106 and protruding laterally; and a carrying strap 116 having a first end 118 fastenable to the first side flap 112 and a second end 120 fastenable to the second side flap 114. The side flaps 112, 114 are foldable so as to accommodate two configurations. In a first configuration the side flaps 112, 114 extend upward so the carrying strap 116 may be utilized as a shoulder strap as shown in FIGS. 1A and 1B. In a second configuration the side flaps 112, 114 are folded across themselves, respectively, and extend laterally so that the carrying strap 116 may be used as a waist strap or waistband as shown in FIGS. 2A and 2B. As there are many different ways to construct a bag, reference to panels 104, 106, 108, 110 does not necessarily mean these panels 104, 106, 108, 110 are separate sheets of material fastened together. Rather, in some embodiments, the panels 104, 106, 108, 110 may be different portions of the same sheet. For example, the front panel 104 and the rear panel 106 may be opposite portions of a single sheet functioning effectively as front and rear panels. In some embodiments, the side panels 108, 110 and the front or rear panels 104, 106 may be portions of a single sheet.

As shown in FIGS. 3A, 3B, 4A, and 4B each side flap 112, 114 protrudes laterally from opposite sides 108, 110 of the carrying bag 100 then longitudinally like an elbow. Each side flap 112, 114 comprises a top edge 300, a medial edge 302 generally perpendicular to the top edge 300, a lateral edge 304 opposite the medial edge 302 away from the bag 100, and generally parallel to the medial edge 302, a front surface 306, a back surface 308, a strap fastener 310 and flap fasteners 312, 314. In some embodiments, the side flaps 112, 114 may be attached to the back panel 106, the side panels 108, 110, or the front panel 104. Positional language, such as medial and lateral, refer to position relative to the carrying bag 100. Thus, medial refers to a position that is in the direction of the carrying bag, whereas lateral refers to a position that is in a direction away from the side of the carrying bag 100.

The strap fastener 310 is attached at the top edge 300 of the side flap 112 or 114 and protrudes in a longitudinal direction relative to the side flaps 112, 114 in the first configuration. Attaching a carrying strap 116 to the side flaps 112, 114 in this first configuration allows the carrying strap 116 to project longitudinally, thereby functioning as a shoulder strap.

Figure 3A:
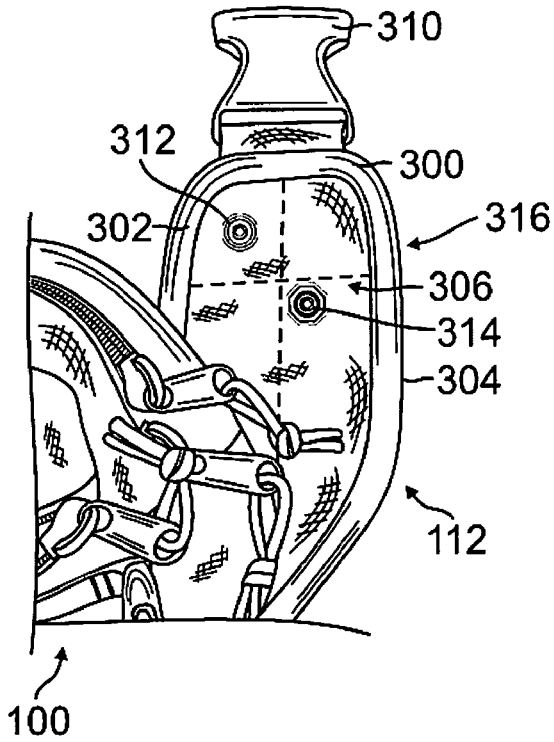
FIG. 3A is a close up of a front view of an embodiment of the flap in the first configuration.
Figure 3B:
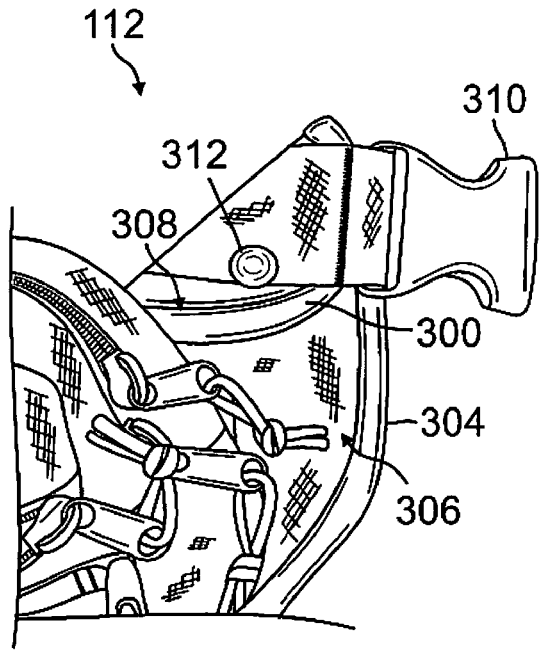
FIG. 3B is a close up of a front view of an embodiment of the flap in the second configuration.
Figure 4A:
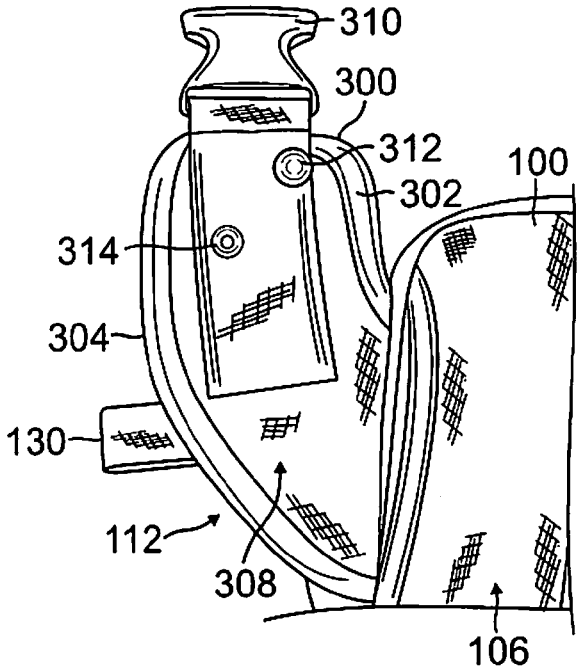
FIG. 4A is a close up of a rear view of an embodiment of the flap in the first configuration.
Figure 4B:
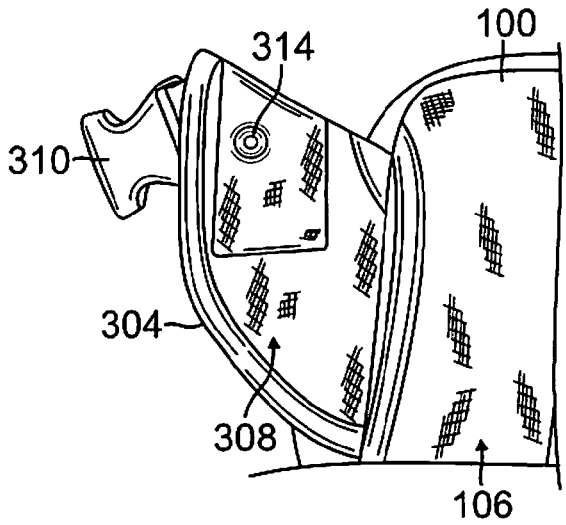
FIG. 4B is a close up of a rear view of an embodiment of the flap in the second configuration.

The top portion 316 of the side flaps 112, 114 is generally a rectangular shape that can be divided into four quadrants: an upper-lateral quadrant, an upper-medial quadrant, a lower-lateral quadrant, and a lower-medial quadrant. The flap fastener comprises a fastener 312 and a reciprocal fastener 314 that connects with the fastener 312. In one embodiment, the fastener 312 is located on the front surface 306 at the upper-medial quadrant of the top portion 316 of the side flap 112. The reciprocal fastener 314 is located diagonally below the fastener 312 on the front surface 306 at the lower-lateral quadrant of the top portion 316 of the side flap so as to fasten the upper medial quadrant to the lower-lateral quadrant. This arrangement allows the upper medial corner to be folded down towards the lower-lateral corner such that the top edge 300 and the lateral edge 304 are adjacent, parallel, and aligned and the fastener 312 is able to connect with the reciprocal fastener 314 as shown in FIG. 3B. In this second configuration the strap fastener 310, which protrudes out from the top edge 300 extends laterally away from the bag 100. The flap fasteners 312, 314 can be configured to have the strap fastener extend medially towards the bag when the flap fasteners 312, 314 are fastened together. The flap fasteners 312, 314 also can be placed on the back surface 308.

In the second configuration with the strap fastener 310 arranged in a medio-lateral orientation, attaching a carrying strap 116 to the strap fastener 310 would also cause the carrying strap 116 to be arranged in a medio-lateral orientation, thereby functioning as a waist strap.

The strap fastener 310 may be any type of quick-release and quick-attaching fastener such as a hook-and-loop fastener, a buckle, a belt, a hook, snap button, or the like. The flap fasteners 312, 314 may be any type of fastener that can maintain the side flap in the folded configuration with minimal movement, such as snap buttons and hook-and-loop fasteners.

Utilizing side flaps 112, 114 in this manner reduces the expense in creating complicated rotating mechanisms that may malfunction, unnecessary swiveling mechanisms that may not lock, or multiple attachment sites that are aesthetically unappealing. Utilizing side flaps 112, 114 that can fasten to itself also provides secure and sturdy positioning as a waist strap. In addition, since the side flaps 112, 114 are constructed entirely from fabric, any tear or damage can be quickly and easily repaired. This feature is beneficial for military personnel who are out in the field with limited supplies. By using needle and thread only, this flap may be repaired easily if damaged.

Thus, this invention describes a method of converting a shoulder strap into a waist strap and vice versa by folding over a side flap 112 or 114 and securing the side flap 112 or 114 on to itself to change the orientation of a strap fastener 310 from projecting upwardly or longitudinally to projecting horizontally or laterally and vice versa.

In some embodiments, the front panel 104 may comprise a gear strap 122 as shown in FIGS. 1A and 2A. In some embodiments, the gear strap 122 extends substantially from the first side panel 108 to the second side panel 110 and is spacedly attached at attachment points 124 to the front panel 104 at various positions to create a plurality of slots 126. These slots 126 may be utilized to hold additional gear or other types of bags and accessories. In some embodiments, the front panel 104 may have a front pocket 105 attached to it. In such embodiments, the gear strap 122 may be attached to the front pocket 105.

In some embodiments, the gear strap 122 may be made of elastic material to quickly and easily insert and remove small gear and equipment such as flashlights, writing implements, small weapons, and the like. In some embodiments, the gear strap 122 may be made of a more durable fabric such as nylon to hold heavier gear or as additional attachment points.

The carrying bag 100 may further have auxiliary fastening sites 128 to provide attachment points for other gear, insignias, or badges. For example, the panels, compartments, or pockets may be lined with hook-and-loop type fasteners, buttons, zippers, or the like to attach to other gear that may have the reciprocal fastening mechanism. In some embodiments, the auxiliary fastening site 128 may secure the handle 132 in a flat position to either facilitate keeping the bag open or to facilitate keeping the bag closed.

For example, the auxiliary fastening site 128 may be located on the front panel 104. In such a case, the front handle 132 may be laid across the main compartment 102 and the back handle 133 may be overlappedly laid on top of the front handle 132, across the main compartment 102 and fastened to the auxiliary fastening site 128 to secure the main compartment closed. Having the auxiliary fastening site 128 on the back panel 106 allows a similar securing process. Alternatively, the back handle 133 may be secured to a back auxiliary fastening site (not shown) and the front handle 132 may be fastened to the front auxiliary fastening site 128 to keep the handles 132, 133 from interfering with the main compartment 102.

In some embodiments, a tightening strap 130 may releasably and adjustably attach the side flaps 112, 114 or the back panel 106 to the front panel 104. Tightening the tightening strap 130 creates a biasing force on the front panel 104 against the back panel 106 so as to fit the curvature of the user's body such that the front panel 104 is physically bent to apply a holding force against the contents of the carrying bag 100 to tightly position the carrying bag 100 close to the user's body and enhance the mobility of the user while carrying the bag 100.

In some embodiments, a hanging strap 318 may be attached to the back panel 106 so as to be able to hang or attach the bag 100 to other gear, for example, the gear strap 122 of another bag. The tightening strap 130, carrying strap 116, and hanging strap 318 may be adjustable to adjust the length of the strap.

As shown in FIG. 1B, the back panel 106 may further comprise a grip 134 to reduce slippage when placed against another surface. The grip 134 provides traction against other surfaces. For example, the grip 134 may provide traction against the wearer. In certain uses, the carrying bag 100 may be used to mount a rifle to provide stability to the rifle. The grip side may be placed on a surface (for example, a table or a vehicle) to provide a stable mount for the rifle.

The grip 134 may be made of any material that has the capability of reducing slippage on a surface, such as rubber, fabric, leather, and any other material that would provide traction, resistance, adhesion, friction, reduced slippage, or the like, between the grip 134 and a surface.

Figure 6A:
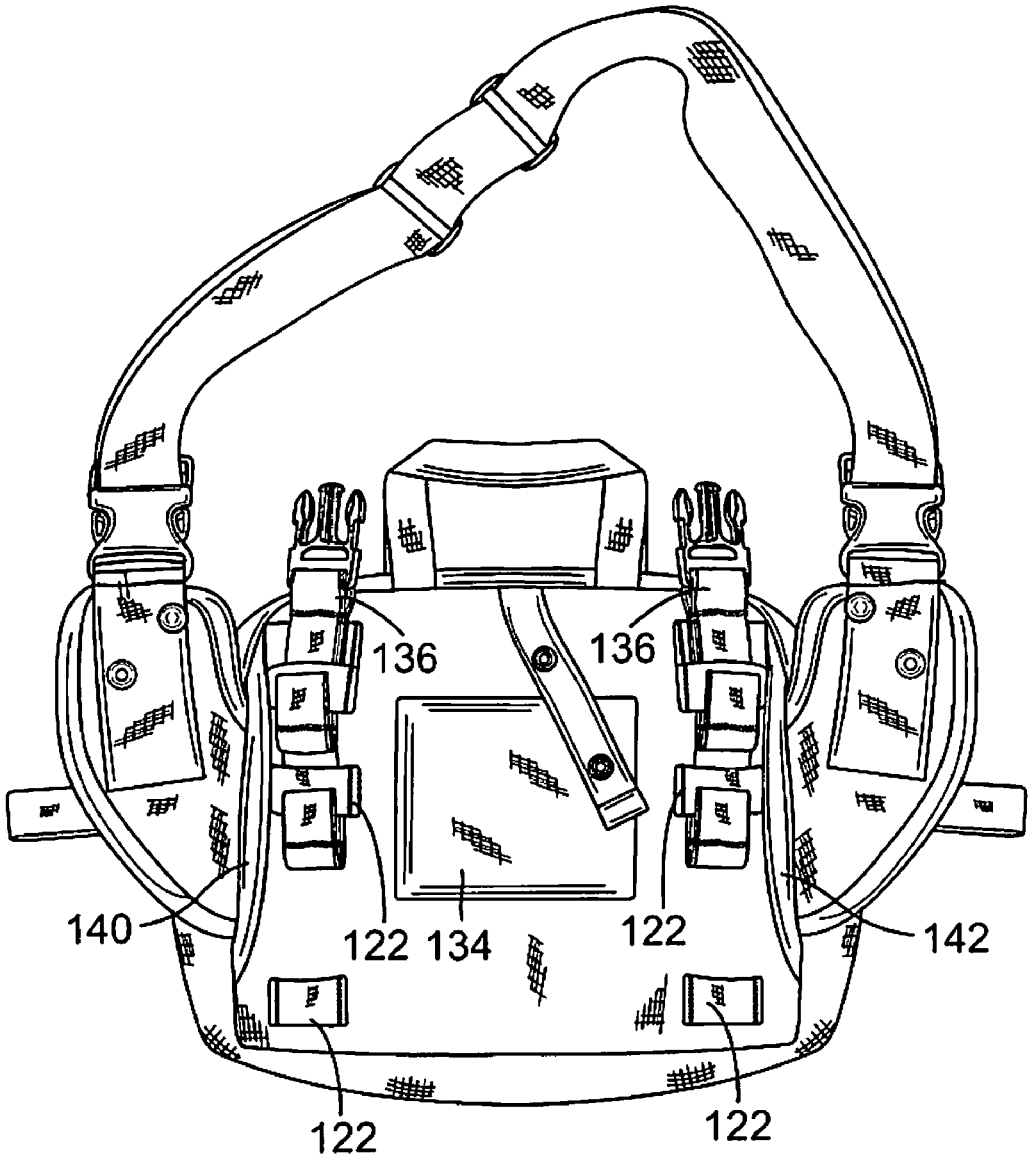
FIG. 6A is a rear view of another embodiment of the current invention.

As shown in FIG. 6A, the rear panel 106 may also comprise gear straps 122. In some embodiments, rather than extending across the full rear panel 106 a plurality of short gear straps 122, each with a single slot 126 may be strategically placed along the rear panel 106. For example, gear straps 122 may be placed along the edges or in the corners of the rear panel 106. An attachment strap or an interfering strap 600 may be used to connect the carrying bag 100 to other gear or to attach other gear to the carrying bag 100.

Figure 6B:
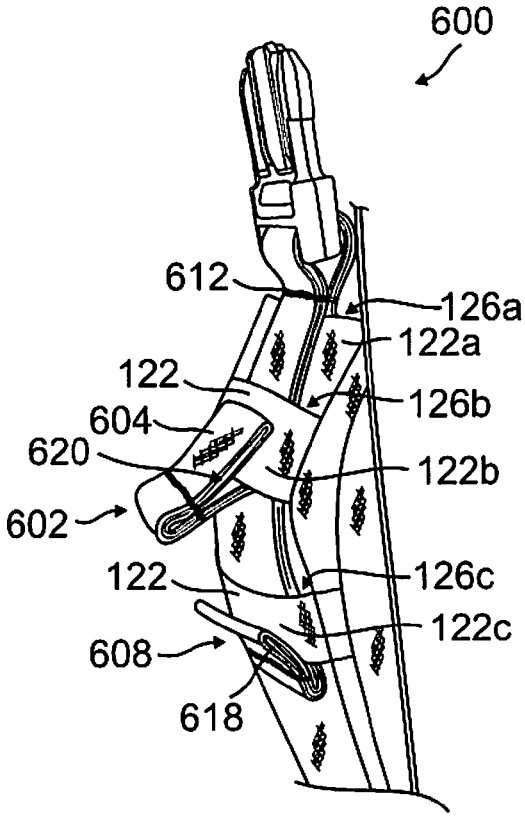
FIG. 6B is a close-up of an interfering strap arrangement.
Figure 6C:
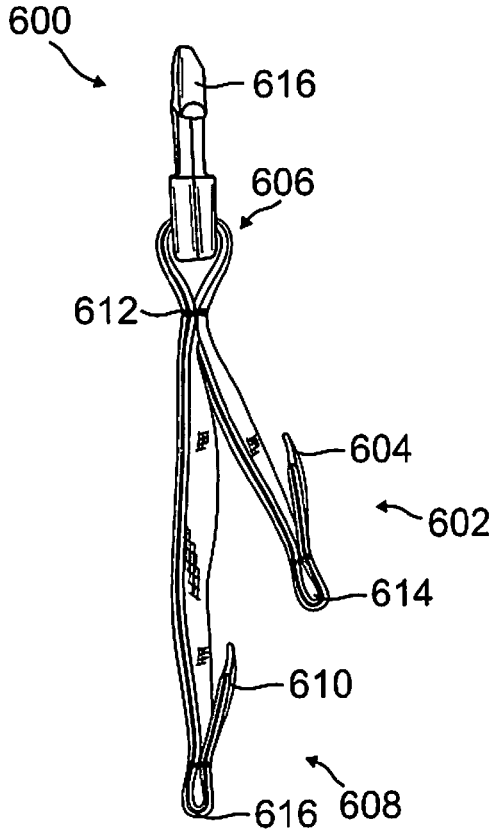
FIG. 6C is an embodiment of the interfering strap.

As shown in FIGS. 6B and 6C, an interfering strap 600 may be an elongated piece of material, such as nylon, formed by folding a free tab end 602 over itself and sewing the free tab end 602 onto the interfering strap 600 leaving a hook piece 604 to "catch" a gear strap 122. The attachment end 606 is connected to a fastener 616, such as a quick-release buckle, hook, hook and loop, snap buttons and the like. The attachment end 606 may be fastened to another gear and the free tab end 604 may be attached to the carrying pack by inserting the free tab end 604 through the gear slot 126 and pulling back to "catch" the hook piece 604 on the gear strap 122. For example, in some embodiments, back pack shoulder straps may be attached to the attachment end 606 so that the carrying bag 100 can be carried like a back pack.

In some embodiments, the interfering strap 600 comprises at least two free tab ends 602, 608 attached at a central attachment site 612, each free tab end 602, 608 having a hook piece 604, 610. The lengths of the free tab ends 602, 608, specifically, the distance from the central attachment site 612 to the tips 614, 616 of the free tab ends 602, 608 may be different. Increasing the number of free tab ends 602, 608 reinforces the strength with which the interfering strap 600 is attached to the carrying bag 100, as each hook piece 604, 610 may be inserted into a slot 126 of a gear strap 122 as shown in FIG. 6B to provide a synergistic reinforcement.

Referring to FIG. 6B, by way of example only, the rear panel may have three gear straps 122*a*, 122*b*, 122*c* defining three gear slots 126*a*, 126*b*, and 126*c*, and the interfering strap 600 may have two free tab ends 602, 608. The first free tab end 608 is fed through all three gear slots 126*a*, 126*b*, 126*c* and hooked to the third gear slot strap 122*c*. The second free tab end 602 is fed through the second gear slot 126*b* and hooked to the second gear strap 122*b*. The interfering strap 600 is now secured to carrying bag 100 and ready for use.

In some embodiments, the hook piece 604 or 610 may also include a reinforcement tab 618. The reinforcement tab 618 may be any stiff material such as wood, metal, plastic, carbon fiber, and the like. In some embodiments, the hook piece 604 or 610 may be stiffened by looping the hook piece 604 or 610 back on itself and stitching or otherwise fastening the hook piece 604 or 610 to itself, thereby increasing the thickness and, therefore, the stiffness. In some embodiments, the hook piece 604 or 610 may be further stiffened by looping the hook piece 604 or 610 back on itself and inserting a reinforcement tab 618 in between the looped portion 620.

Figure 5:
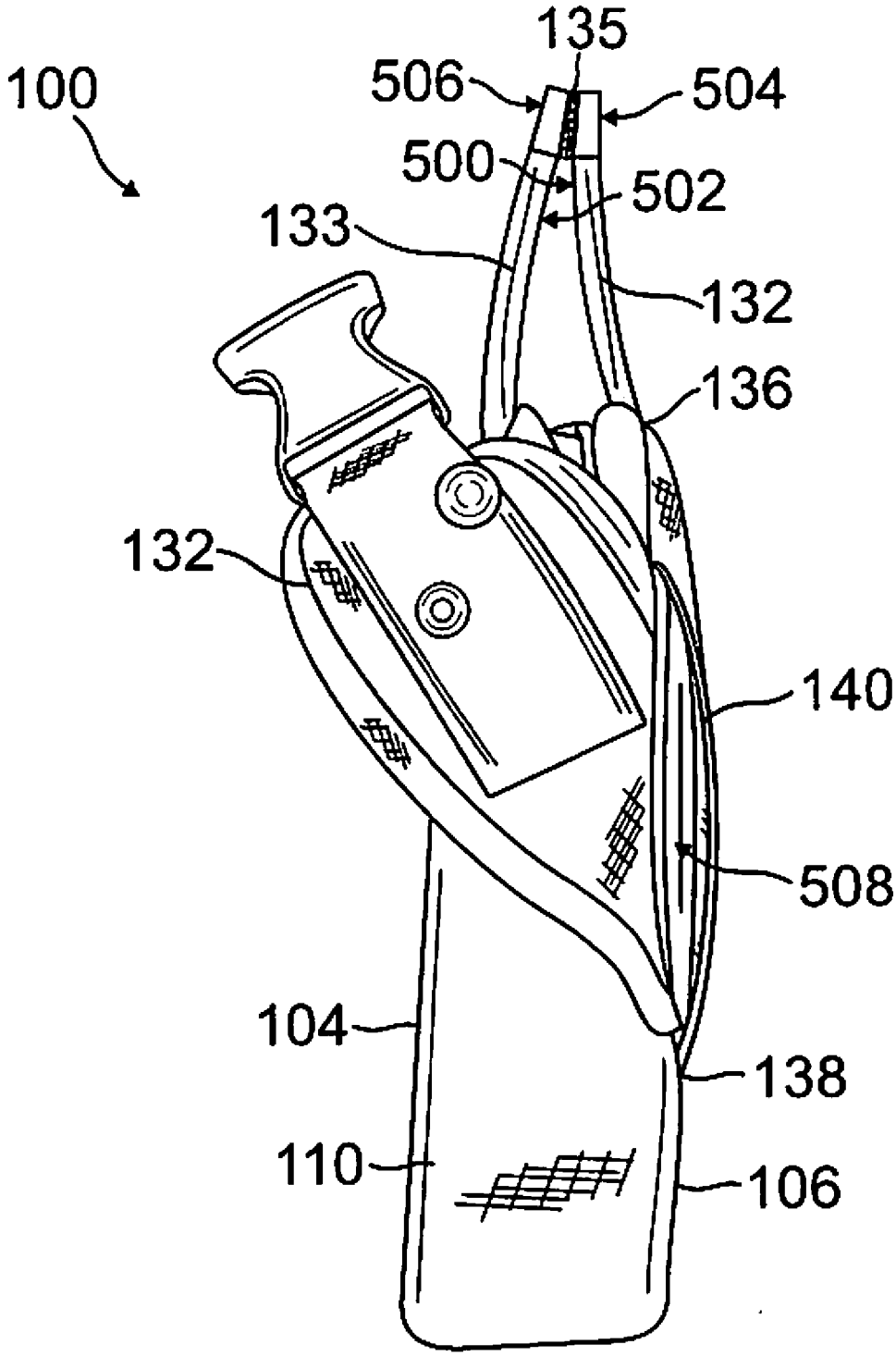
FIG. 5 is a side view of an embodiment of the current invention.

As shown in FIG. 5, the rear panel may further comprise a waist pouch 508. The waist pouch 508 is essentially a through pocket attached to the rear panel 106 at its top 136 and bottom 138 edges. The top 136 and bottom 138 edges may be fixedly attached, such as being sewn, glued, or otherwise irremovably attached. At least a portion of the two side edges 140, 142 may comprise hook-and-loop fasteners so as to be removably attached so that the interior of the waist pouch 508 can be accessed. The waist pouch 508 can be used as a pocket to hold additional items, such as bladder type containers. The waist pouch 508 may also be used like a belt loop to secure the carrying bag 100 to a belt or the like as an alternative and more secure way of carrying the carrying bag 100 on the waist.

In embodiments comprising the waist pouch 508, the rear gear straps 122, and the grip 134, may be attached to the waist pouch 508 instead of the rear panel 106 depending on how extensively the waist pouch 508 covers the rear panel 106.

The bag 100 may further comprise a handle 132 or a pair of handles 132, 133 extending upwardly from the top portion of the front and/or rear panels 104, 106. The handles 132, 133 may further comprise a fastener 135, such as a hook-and-loop fastener, snap buttons, buckles or the like to hold the handles together. Preferably, the handles 132, 133 comprise a hook and loop fastener 135 to mate the handles 132, 133 together for easy carrying. In some embodiments, the handles 132 are overlappedly mated, one on top of the other, as is the case for traditional bags with the capability of fastening the handles 132, 133 together. In other words, the outer side 504 of the first handle 132 may be fastened to the inner side 502 of the second handle 133, or vice versa, the outer side 506 of the second handle 133 is mated to the inner side 500 of the first handle 132.

In some embodiments, as shown in FIG. 5, the handles 132, 133 are not overlappedly mated. Rather, the first handle 132 is mated to the second handle 133 such that the inner side 500 of the first handle 132 is fastened to the inner side 502 of the second handle 133. Such a configuration allows for quicker access to the main compartment 102.

When the handles 132, 133 are attached with the inner sides 500, 502 mated together, a user desiring to open the main compartment 102 grabs the zipper of the main compartment 102 and pulls quickly across the length of the bag 100. During this process, the force of the user's hand as it intersect with the handles 132, 133, creates lateral biasing forces pushing the handles 132 apart from one end to the other. Due to this configuration, the first end of the handle separates, and the separation continues until the handles are apart. Alternatively, the user can simply grasp the handles and pull them apart easily.

By contrast, when the inner sides 500, 502 of the handles are mated with the outer sides 506, 504, respectively, the user's hands intersecting the handles 132, 133 creates the same biasing force; however, this configuration creates a sliding action on the fasteners causing the hook and loop to slide along each other rather than being pushed away from each other. As such, more force would be required to release the handles 132, 133 from each other reducing the quickness with which the main compartment can be accessed.

In some embodiments, the auxiliary fastening site 128 is located on the front panel 104 or the top of the front pocket 105 just below the handles 132. The hook and loop fastener of the handles 132 may be configured to also mate with the auxiliary fastening site 128. This configuration allows a first handle 132 to be tucked under a second handle 133, with the second handle 133 fastened to the auxiliary fastening site 128. This secures the handles 132, 133 flat against the carrying bag 100 for easy storage and transport. In addition, it provides an additional means for keeping the carrying bag 100 closed. In some embodiments, the auxiliary fastening site 128 may be used to attach insignias, badges, or other indicators to identify the contents of the bag 100 or the owner.

The carrying bag 100 may further comprise a plurality of compartments 102, including pockets within compartments. The pockets and compartments 102 may have various closure mechanisms including buttons, hook-and-loop fasteners, zippers, draw strings, or the like. In a preferred embodiment, the carrying bag comprises a zippered main compartment 102 and a bellowed zippered front pocket 105 attached to the front panel 104. The main compartment 102 may have a plurality of draw corded pouches and flat pouches. The inside of the compartments may further comprise fastening straps 702 with hook-and-loop type fasteners to fasten various gears, tools, and any other accessories such as water bottles or other non-flat shaped objects that would not easily fit into the pockets. The compartments or pockets may be pleated for expansion.

In some embodiments, as shown in FIG. 7, to improve the versatility of the compartments, the main compartment 102 may be empty and drop-in pocket inserts 700 may be utilized to compartmentalize particular gear based on the necessary use. The drop-in inserts are self-sustaining compartmentalizations that are simply dropped into an empty compartment 102. The inserts thereby divide the empty compartment 102 into multiple compartments or pockets. The drop-in pockets may have a means for closing each pocket such as hook-and-loop fasteners, snap buttons, draw string cords, and the like. These drop-in pockets 700 may come in a variety of shapes and sizes to accommodate various uses. Thus, one carrying bag may have a plurality of uses. By way of non-limiting example, a single carrying bag 100 may be used as a medical kit, a sniper kit, a breacher kit for explosives, a survival kit, a tool kit, a lap top or file carrying case, and a cameral kit. Each kit may require specific compartmentalization of the gears associated with that kit. The drop-in pocket inserts 700 may be configured to accommodate the specific needs of each kit.

The compartments may be configured differently, depending on the intended use for the carrying bag. For example, padded inserts may be used to protect fragile items such as cameras, laptops, and the like. Additional compartments may be added to separate out equipment that needs to be separated, such as separating a detonator system from the charges.

The bag may be made of any type of durable material such as cotton, canvas, nylon, leather, or the like.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

INDUSTRIAL APPLICABILITY

This invention may be industrially applied to the development, manufacture, and use of carrying bags comprising side flaps that attach to carrying straps, wherein the side flaps comprise fasteners and can fold and attach to itself so that in the folded configuration the carrying strap functions as a waist strap and in the unfolded configuration the carrying strap functions as a shoulder strap.

What is claimed is:

1. A carrying bag, comprising:

a. a front panel;

b. a back panel opposite the front panel;

c. a first and second side panel, each adjacent to the front panel and the back panel at opposite ends;

d. a bottom panel adjacent to the front panel, the back panel, and the two side panels, thereby defining a main compartment;

e. a first side flap attached to the carrying bag adjacent to the first side panel and protruding laterally away from the carrying bag;

f. a second side flap attached to the carrying bag adjacent to the second side panel and protruding laterally away from the carrying bag, wherein each side flap comprises a top edge, a medial edge adjacent to the carrying bag, a lateral edge opposite the medial edge away from the carrying bag, a bottom edge opposite the top edge and adjacent to the lateral edge, a flap fastener adjacent to the top edge and medial edge, and a reciprocal flap fastener to fasten with the flap fastener, the reciprocal flap fastener positioned adjacent to the lateral edge;

g. wherein each side flap comprises a strap fastener attached to their respective top edges, each strap fastener having a first configuration wherein the flap fastener and the reciprocal flap fastener are unfastened and the strap fastener protrudes in a first direction, and a second configuration wherein each side flap is folded and the flap fastener is fastened to the reciprocal flap fastener leaving the strap fastener exposed and protruding laterally in a second direction away from the carrying bag and perpendicular to the first direction;

h. a first handle attached to the back panel and a second handle attached to the front panel, each handle comprising an inner side facing each other and an outer side facing away from each other, wherein the inner sides each comprise a quick-release fastener to fasten the first handle to the second handle at the inner sides;

i. an auxiliary fastening site located on a panel selected from the group consisting of the front panel and the back panel, wherein the first and second handles are fastenable to the auxiliary fastening site;

j. a grip attached to the back panel; and k. a drop-in pocket insert configured to removably fit into the main compartment to define a plurality of pockets.

2. The carrying bag of claim 1 further comprising a tightening strap releasably and adjustably attaching the first side flap to the front panel to create a biasing force on the front panel against the back panel.

3. The carrying bag of claim 1 further comprising a hanging strap attached to the back panel.

4. The carrying bag of claim 1, wherein the back panel comprises a waist pouch.

5. The carrying bag of claim 1 further comprising a gear strap attached to at least one panel selected from the group consisting of the front panel, the back panel, the first side panel, and the second side panel.

6. The carrying bag of claim 5, wherein the gear strap extends substantially from the first side panel to the second side panel and is spacedly attached to the front panel at attachment points to define a plurality of slots.

7. The carrying bag of claim 5 further comprising an interfering strap comprising a hook portion and a attachment end, wherein the hook portion attaches the interfering strap to the carrying bag and the attachment end attaches the interfering strap to a separate gear.

8. A carrying bag, comprising:

a. a front panel;

b. a back panel opposite the front panel;

c. a first and second side panel, each adjacent to the front panel and the back panel at opposite ends;

d. a bottom panel adjacent to the front panel, the back panel, and the two side panels, thereby defining a main compartment;

e. a first side flap attached to the carrying bag adjacent to the first side panel and protruding laterally away from the carrying bag; and f. a second side flap attached to the carrying bag adjacent to the second side panel and protruding laterally away from the carrying bag, g. wherein each side flap comprises:

i. a top edge;

ii. a medial edge adjacent to the carrying bag;

iii. a lateral edge opposite the medial edge away from the carrying bag;

iv. a bottom edge opposite the top edge and adjacent to the lateral edge;

v. a flap fastener adjacent to the top edge and medial edge; and vi. a reciprocal flap fastener to fasten with the flap fastener, the reciprocal flap fastener positioned adjacent to the lateral edge;

vii. wherein each side flap comprises a strap fastener attached to their respective top edges, each strap fastener having a first configuration wherein the flap fastener and the reciprocal flap fastener are unfastened and the strap fastener protrudes in a first direction, and a second configuration wherein each side flap is folded and the flap fastener is fastened to the reciprocal flap fastener leaving the strap fastener exposed and protruding laterally in a second direction away from the carrying bag and perpendicular to the first direction.

9. The carrying bag of claim 8 further comprising an auxiliary fastening site.

10. The carrying bag of claim 8 further comprises a first handle attached to the back panel and a second handle attached to the front panel, each handle comprising an inner side facing each other and an outer side facing away from each other, wherein the inner sides each comprise a quick-release fastener to fasten the first handle to the second handle at the inner sides.

11. The carrying bag of claim 8 further comprising a tightening strap releasably and adjustably attaching the first side flap to the front panel to create a biasing force on the front panel against the back panel.

12. The carrying bag of claim 8 further comprising a hanging strap attached to the back panel.

13. The carrying bag of claim 8 further comprising a grip attached to the back panel to provide traction.

14. The carrying bag of claim 8 further comprising a gear strap attached to at least one panel selected from the group consisting of the front panel, the back panel, the first side panel, and the second side panel.

15. The carrying bag of claim 14, wherein the gear strap extends substantially from the first side panel to the second side panel and is spacedly attached to the front panel at attachment points to define a plurality of slots.

16. The carrying bag of claim 14 further comprising an interfering strap comprising a hook portion and a attachment end, wherein the hook portion attaches the interfering strap to the carrying bag and the attachment end attaches the interfering strap to a separate gear.

17. The carrying bag of claim 8, wherein the back panel comprises a waist pouch.

18. The carrying bag of claim 8, further comprising a removable and adjustable drop-in pocket insert.

19. A method of altering a configuration of a carrying bag, comprising:

a. providing a carrying bag comprising:

i. a first side flap attached to the carrying bag adjacent to a first side protruding laterally away from the carrying bag; and ii. a second side flap attached to the carrying bag adjacent to a second side and protruding laterally away from the carrying bag, iii. wherein each side flap comprises:

1. a top edge;

2. a medial edge adjacent to the carrying bag;

3. a lateral edge opposite the medial edge away from the bag;

4. a bottom edge opposite the top edge;

5. a flap fastener adjacent to the top edge and medial edge;

6. a reciprocal flap fastener to fasten with the flap fastener, the reciprocal flap fastener positioned adjacent to the lateral edge; and 7. a strap fastener attached to the top edge adjacent to the flap fastener, wherein in a first configuration the flap fastener and the reciprocal flap fastener are unfastened and the strap fastener protrudes in a first direction, and b. folding the first and second side flaps such that the top edges align with the respective lateral edges to form a second configuration, wherein the strap fastener is exposed and protrudes laterally in a second direction away from the carrying bag and perpendicular to the first direction.

20. The method of claim 19 further comprising fastening the flap fastener of each side flap to their respective reciprocal flap fastener.

* * * * *